United States Patent [19]

Marzocco

[11] Patent Number: 5,052,139

[45] Date of Patent: Oct. 1, 1991

[54] GUN-LOADED INDICATOR DEVICE FOR SHOTGUNS

[75] Inventor: Alessandro Marzocco, Milan, Italy

[73] Assignee: Luigi Franchi S.p.A., Fornaci, Italy

[21] Appl. No.: 640,723

[22] Filed: Jan. 14, 1991

[30] Foreign Application Priority Data

Jan. 18, 1990 [IT] Italy ..... 20462/90[U]

[51] Int. Cl.[5] ..... F41A 9/53

[52] U.S. Cl. ..... 42/1.05

[58] Field of Search ..... 42/1.05

[56] References Cited

U.S. PATENT DOCUMENTS

| | | | |
|---|---|---|---|
| 385,360 | 7/1888 | Lefever | 42/1.05 |
| 439,551 | 10/1890 | Pheatt | 42/1.05 |
| 790,634 | 5/1905 | Hirsh | 42/1.05 |
| 1,992,934 | 3/1935 | Bamberger | 42/1.05 |
| 2,102,195 | 12/1937 | Conniffe | 42/1.05 |
| 4,103,639 | 8/1978 | Otteson | 42/1.05 |

*Primary Examiner*—Charles T. Jordan

*Attorney, Agent, or Firm*—Diller, Ramik & Wight

[57] ABSTRACT

A gun-loaded indicator device for shotguns of the type in which a cartridge chamber is defined at the breech end of a barrel removably mounted in a stock (3), comprises a feeler ball (9) movable within a through hole (10) provided in the breech end and opening into the cartridge chamber and extending radially to it and comprises a bar-like lever (13) pivoted within the stock (3) and having a first end (13*a*) maintained in contact with the feeler ball (9) and its second end (13*b*) subjected to spring means (15); the lever (13) is angularly mobile within a respective conjugate seat (16) from a position in which the first end (13*a*) of the lever (13) is in line with the stock (3) to a position in which the first end (13*a*) projects laterally from it.

2 Claims, 2 Drawing Sheets

GUN-LOADED INDICATOR DEVICE FOR SHOTGUNS

This invention relates to a gun-loaded indicator device for shotguns and the like.

The main object of the present invention is to provide a gun-loaded indicator device, the structural and operational characteristics of which are such as to ensure immediate indication of the presence of a cartridge in the cartridge chamber of the gun, and which at the same time represents an improvement in terms of convenience and practicality of use.

This and further objects which will be more apparent from the following description are attained by a gun-loaded indicator device for shotguns of the type in which a cartridge chamber is defined at the breech end of a barrel removably mounted in a stock, characterised by comprising a feeler ball movable within a through hole provided in said breech end and opening into said cartridge chambler and extending radially to it, and a bar-like lever pivoted within said stock and having a first end maintained in contact with the feeler ball and its second end subjected to spring means, said lever being angularly mobile within a respective conjugate seat from a position in which said first end of the lever is in line with the stock to a position in which said first end projects laterally from it.

The characteristics and advantages of the invention will be more apparent from the description of one embodiment thereof given hereinafter with reference to the accompanying non-limiting drawings in which.

Figure 1:
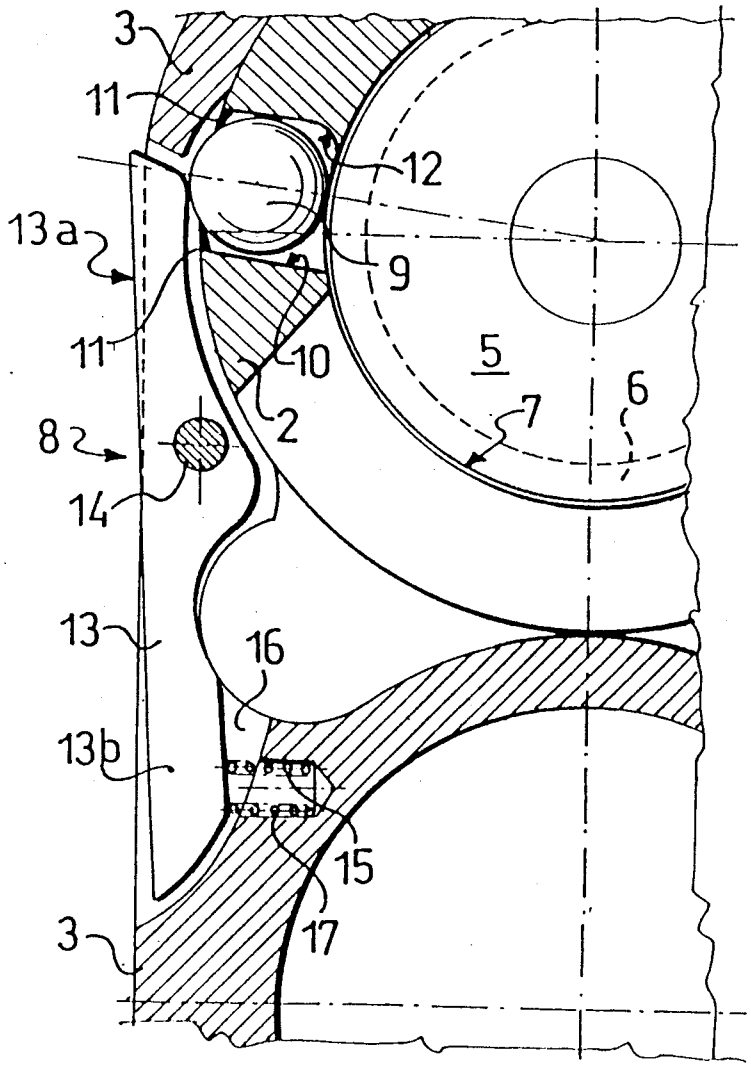
FIG. 1 is a cross-section through part of a shotgun provided with a gun-loaded indicator device according to the present invention, for indicating the presence of a cartridge in the cartridge chamber.
Figure 2:
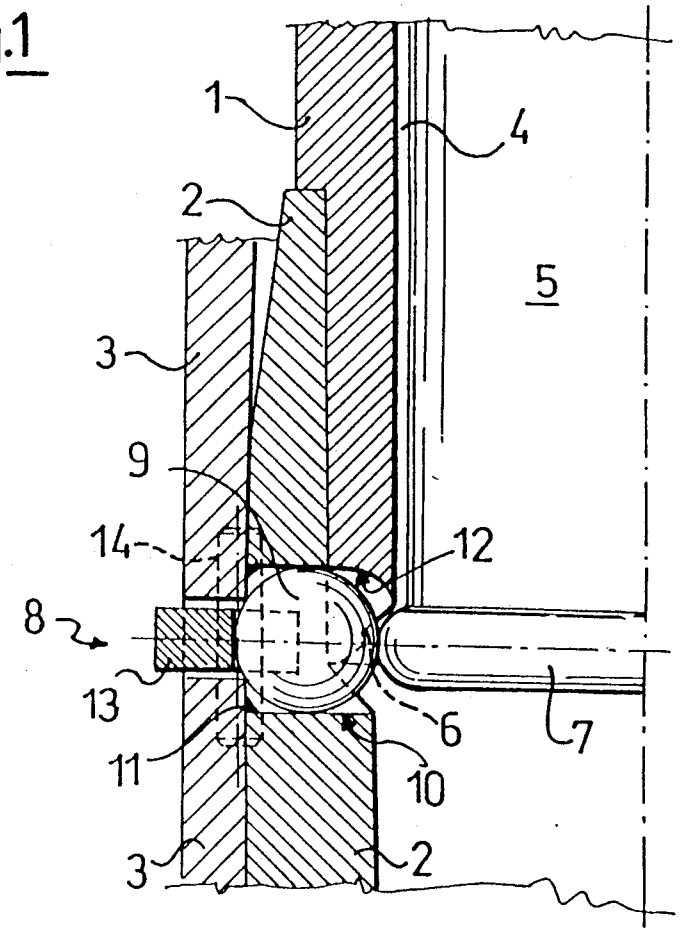
FIG. 2 is a longitudinal section through further parts of the shotgun shown in FIG. 1.

A shotgun or security gun of the type partly shown in said figures comprising a barrel 1 and a breech 2 removably associated with each other, for example by means of a threaded connection. The barrel 1 and breech 2 are also removably connected in known manner to a gun stock 3 such that they can be removed from this latter, for example for gun cleaning and maintenance purposes.

A cartridge chamber 4 intended to receive a cartridge 5 is provided at an end portion of the barrel 1.

The cartridge chamber 4 is provided circumferentially at the breech end of the barrel 1 with a seat 6 against which the bottom 7 of the cartridge 5 abuts.

The gun-loaded indicator device of the present invention is indicated overall by 8. The device 8 comprises a steel feeler ball 9 movable within a through hole 10 extending radially to the cartridge chamber 4 partly within the breech 2 and partly within the breech end of the barrel 1. The hole 10 therefore opens into the cartridge chamber 4 in a position corresponding with the circumferential stop seat 6 for the cartridge bottom 7.

The feeler ball 9 is slidingly guided within the hole 10 between a first stop formed by an annular projection 11 jutting from the inner wall of the hole 10, and a second stop formed by curved part 12 of the hole 10 provided in the breech end of the barrel 1.

The device 8 also comprises a bar-like lever 13 pivoted on a respective pin 14 and housed in a conjugate seat 16 provided transversely in the stock 3 at said seat

6. The lever 13 is provided with respective spring means 15 housed in a blind hole 17 provided in the stock 3.

The lever 13 comprises an upper end 13*a* which cooperates with the feeler ball 9, and a lower end 13*b* on which said spring means 15 act.

In the condition shown in FIG. 1, i.e. with the gun loaded, the bottom 7 of the cartridge 5 interferes with the feeler ball 9 of the device 8.

The feeler ball 9 thus acts on the upper end 13*a* of the lever 13 to cause it to project laterally from the outline of the stock 3 against the spring means 15. Under these conditions the lower end 13*b* of the lever 13 is located within the stock 3.

The presence of the cartridge 5 in the cartridge chamber is in this manner determinable both visually and by touch. It should be noted that the ability to obtain this information by touch means that the user is able to constantly check that a cartridge is present in the cartridge chamber during the use of the gun. To facilitate visual perception of the upper end 13*a* of the lever 13, this latter can be advantageously coloured with bright colours.

Figure 4:
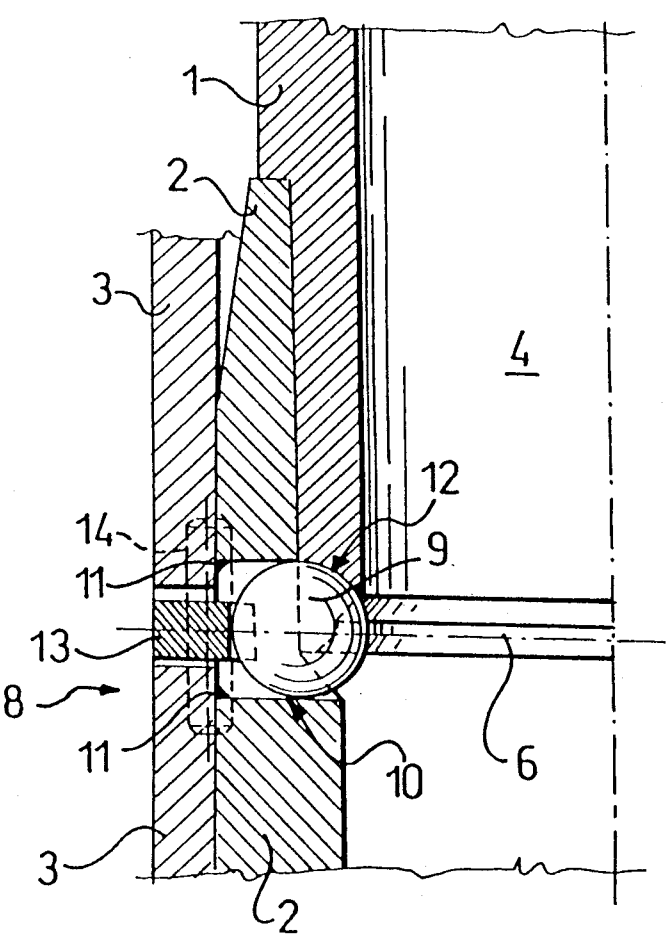
FIG. 4 is a longitudinal section through the part shown in FIG. 3.
Figure 3:
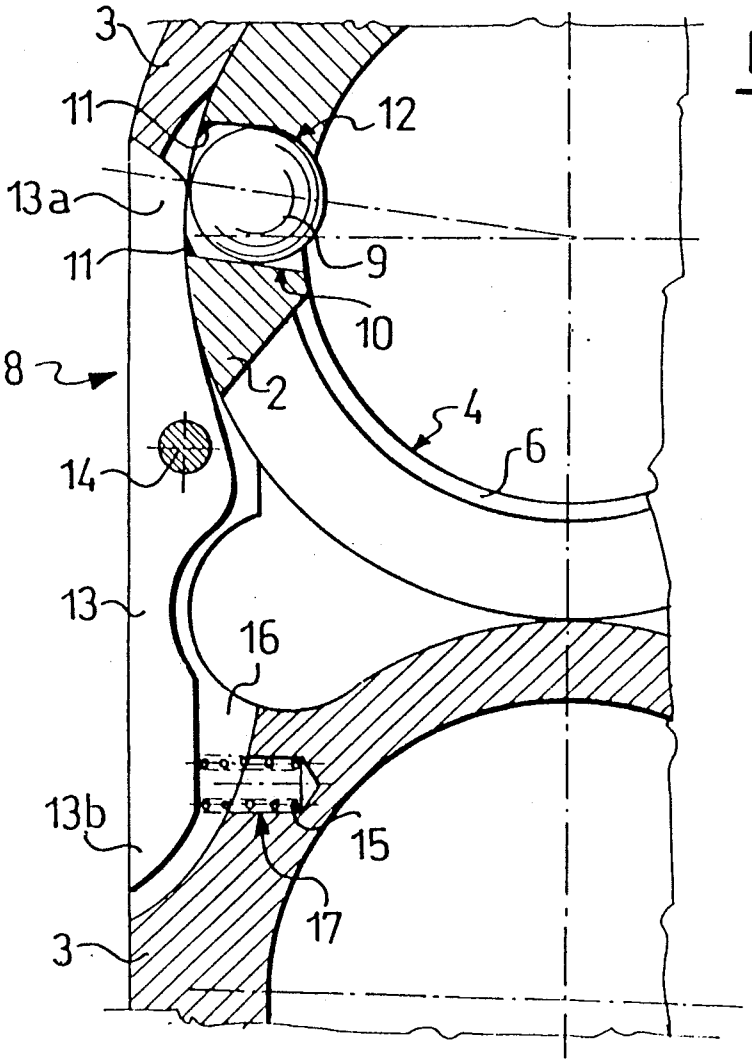
FIG. 3 is a cross-section through the part shown in FIG. 1 but without a cartridge in the cartridge chamber.

When the cartridge chamber 4 is empty the indicator device 8 according to the present invention is in the configuration shown in FIGS. 3 and 4.

In this configuration the feeler ball 9 is no longer urged by the cartridge bottom 7, and therefore rests against the curved part 12 of the hole 10, pushed by the upper end 13*a* of the lever 13, which is rotated by the spring means 15. In this manner the lever 13 is substantially in line with the stock 3, so immediately indicating the absence of a cartridge in the cartridge chamber 4. The gun-loaded indicator device of the present invention does not interfere with the removal of the barrel-breech unit from the gun stock. In this respect the feeler ball 9 and the lever 13 are retained in the hole 10 and in the seat 16 respectively by the part 12, the annular projection 11 and the pin 14.

The feeler ball 9 does not impede the movement of the breech-block, which has to move close to the cartridge bottom 7 to implement firing. As the feeler 9 is rotated each time a cartridge is introduced into and extracted from the cartridge chamber 4 it is self-cleaning and prevent deposition of incrustation due to the firing gas.

The indicator device 8 according to the present invention not only allows simpler and more practical use of the gun, but also improves its appearance.

I claim:

1. A gun-loaded indicator device for shotguns of the type in which a cartridge chamber (4) is defined at the breech end of a barrel (1) removably mounted in a stock (3), characterised by comprising a feeler ball (9) movable within a through hole (10) provided in said breech end and opening into said cartridge chamber (4) and extending radially to it, a bar-like lever (13) pivoted within said stock (3) and having a first end (13*a*) maintained in contact with the feeler ball (9) and its second end (13*b*) subjected to spring means (15), said lever (13) being angularly mobile within a respective conjugate seat (16) from a position in which said first end (13*a*) of the lever (13) is in line with the stock (3) to a position in which said first end (13*a*) projects laterally from it.

2. A device as claimed in claim 1, characterised in that said feeler ball (9) is slidingly guided within said hole (10) between a first stop formed by an annular projection (11) jutting from the hole inner wall, and a second stop formed by curved portion (12) of said hole (10).

* * * * *